United States Patent [19]

McDonald et al.

[11] Patent Number: 4,936,397

[45] Date of Patent: Jun. 26, 1990

[54] EARTH DRILLING APPARATUS WITH CONTROL VALVE

[75] Inventors: William J. McDonald; William C. Maurer, both of Houston, Tex.

[73] Assignee: Slimdril International, Inc., Houston, Tex.

[21] Appl. No.: 328,890

[22] Filed: Mar. 27, 1989

[51] Int. Cl.[5] ..... E21B 4/02; E21B 34/10; E21B 44/00

[52] U.S. Cl. ..... 175/26; 175/61; 175/71; 175/107; 175/317

[58] Field of Search ..... 175/107, 92, 103, 26, 175/61, 71; 418/48; 417/21; 415/36

[56] References Cited

U.S. PATENT DOCUMENTS 3,989,114 11/1976 Tschirky et al. ..... 175/107

4,834,193 5/1989 Leitko et al. ..... 175/26 X

*Primary Examiner*—Stephen J. Novosad

*Attorney, Agent, or Firm*—Neal J. Mosely

[57] ABSTRACT

An earth drilling apparatus has a pneumatic motor operated earth drilling tool, a valve assembly connected to the motor, and a drill string connected to the valve and to a source of pneumatic fluid. The drilling tool has an earth drilling bit and a rotor/stator motor section to apply a rotational force to rotate the bit at the bottom of the string. The valve assembly is disposed between the drilling tool motor and the source of pneumatic fluid and controls the flow of pneumatic fluid to the tool. The valve assembly has a pneumatic pressure-operated valve which is operable in response to the pressure of pneumatic fluid in the drill string to be opened to permit flow of pneumatic fluid to the tool at a predetermined operating pressure to transmit an initial pulse of pneumatic fluid to initiate operation of the motor. The valve is kept open at a lower pressure than that required to open it. The valve is a pressure operated valve, spring-loaded toward closed position, which opens at a first predetermined pneumatic pressure permitting flow to said tool and closes at a second, substantially lower, pneumatic pressure.

16 Claims, 3 Drawing Sheets

EARTH DRILLING APPARATUS WITH CONTROL VALVE

BACKGROUND OF THE INVENTION

1. FIELD OF THE INVENTION

This invention relates generally to downhole drilling motor apparatus of the positive displacement type, and more particularly to an air motor operated drilling tool coupled with a control valve in the power fluid supply line which prevents fluid supply to the drilling tool until a desired line pressure is obtained.

2. BRIEF DESCRIPTION OF THE PRIOR ART

It is known in the art of drilling well bores to utilize a drill pipe or drill string which has attached at its lower end a downhole drilling tool utilizing a positive displacement motor, the drive section of which is connected to, and rotates, a drill bit. In such apparatus a fluid, e.g., air, foam, or a relatively incompressible liquid, is forced down the drill string and on passing through the fluidoperated motor, causes rotation of a shaft ultimately connected to the drilling bit.

As the downhole drilling tool progress away from the drilling rig, more drill pipe is added between the motor (rotor/stator) and the drilling plateform or rig. As each joint of drill pipe is added to the drill string, air flow to the motor must be interrupted and the drill string emptied of air pressure. Once the connection of another joint of drill pipe is completed, the air flow to the downhole drilling tool can be initiated. Thus, the drill pipe is, in effect, forming an ever increasing expansion chamber as the drilling tool advances.

Expansion of the compressed air entering the empty drill string drastically reduces the initial air pressure and energy potential available to start the tool in operation. This energy potential builds up slowly because of a limited or fixed capacity for generating compressed air entering the lengthened drill pipe. The time required to fill the pipe increases as the length and/or diameter of pipe increases. Conventional downhole air motor drilling tools are difficult to start when they are at the bottom of the hole due in part to the compressibility of air and the flow restrictions of the drill cause the air pressure at the bottom of the string (adjacent the motor) to build up slowly. The aforementioned motors are also subject to leak paths at low pressure in the rotor/stator section which progressively open and allow air to bypass through the motor.

Another factor which causes difficult starting of the air motors is that they require a certain impulse of initial energy to initiate operation because of rotor/stator inertia, and internal friction and leakage. This may be further aggravated by ineffective lubrication or frost conditions from air expansion within the tool. In cold atmospheric conditions, an air motor may freeze moisture in the tight seal areas. Similar difficulties could occur from excessive drag on the drill bit. However, if pressure is applied to the motor in a substantially instantaneous manner, the motor will start and operate in a normal fashion. The present apparatus utilizes a control valve which allows an instantaneous, high-pressure blast of air to the down hole drilling tool motor to overcome the problem of difficult starting conditions such as those caused by long drill strings, a wet borehole, or freeze-up conditions.

There are several patents which disclose various valves having pressure operated mechanisms, none of which are used in the power fluid supply line of positive displacement drilling motors of downhole drilling tools, or utilize the present mechanism to prevent fluid supply to the pneumatic positive displacement motor of a downhole drilling tool until a desired line pressure is obtained.

Mason, U.S. Pat. No. 3,180,433 discloses a jar for drilling having a latch to prevent actuation of the tool until a predetermined velocity of the drive fluid is reached.

Jacobi, U.S. Pat. No. 2,276,979 Edman, U.S. Pat. No. 2,844,166, and Tennis, U.S. Pat. No. 2,848,014 disclose valves having pressure operated latch mechanisms, but not for controlling an air-pressure-operated earth boring tool.

Zinkiewicz, U.S. Pat. No. 3,137,483 discloses a ground burrowing device which utilizes a check valve rather than a pneumatic pressure operated valve. The Zinkiewicz valve operates by differential pressure or flow and would be opened by any small pressure difference between the front and back side of the valve. The valve is opened by application of pressure produces by movement of the hammer and not in response to air line pressure.

Kostylev et al, U.S. Pat. No. 4,629,008 discloses a percussive tool which utilizes a spring loaded valve but the valve is not responsive to air line pressure to prevent flow to the tool until air line pressure reaches a predetermined level.

The cited prior art and any other prior art known to applicants does not show an air operated downhole drilling tool having a control valve which prevents flow of air pressure to the tool until the air-line pressure reaches a predetermined level adjacent to the tool.

SUMMARY OF THE INVENTION

It is therefore an object of this invention to provide a cost-effective system of apparatus for drilling straight or deviated bore holes in earth formations including an in-line control valve used adjacent to an air-operated downhole earth drilling tool that offers a repeatable and useful starting and operating response and which is compatible with existing boring equipment and methods.

Another object of this invention is to provide a system of apparatus for downhole drilling including an in-line control valve used adjacent to an air-operated downhole earth drilling tool which will supply the motor of the tool with a high energy starting pulse of working fluid to facilitate initiation of the tool operation.

Another object of this invention is to provide a system of apparatus for downhole drilling including an in-line control valve used adjacent to an air-operated downhole earth drilling tool wherein fluid is switched automatically at a pre-set pressure by fluid introduced from the opposite end of a drill string composed of multiple joints of pipe.

Another object of this invention is to provide a system of apparatus for earth boring including an in-line control valve used adjacent to an air-operated downhole earth drilling tool wherein a valve piston is opened and held so by the fluid pressure while supplying working fluid to operate the drilling tool.

Another object of this invention is to provide a system of apparatus for downhole drilling including an in-line control valve used adjacent to an air-operated downhole earth drilling tool which will automatically close after fluid flow to the valve has been interrupted by an upstream valve, thereby positioning the valve for another high energy pulse to restart the boring tool.

Another object of this invention is to provide a system of apparatus for downhole drilling including an in-line control valve used adjacent to an air-operated downhole earth drilling tool in which the valve body is in the form of a sub which may be placed within a pipe string at any desired point and is not restricted as to the size or design of the tool joint being used and is applicable to a wide range of drill pipe.

Another object of this invention is to provide a system of apparatus for downhole drilling including an in-line control valve used adjacent to an air-operated downhole earth drilling tool in which the valve body is in the form of a cartridge which may be installed inside the drill string at the threaded connection of two joints of drill pipe and may be quickly replaced by simply exchanging cartridges.

A still further object of this invention is to provide a system of apparatus for downhole drilling including an in-line control valve used adjacent to an air-operated downhole earth drilling tool which is simple in design, economical to manufacture, and rugged and durable in use.

Other objects of the invention will become apparent from time to time throughout the specification and claims as hereinafter related.

The above noted objects and other objects of the invention are accomplished by a system of apparatus comprising an air motor operated downhole drilling tool with a control valve which prevents flow of air pressure to the motor of the tool until the air-line pressure reaches a predetermined level adjacent to the tool.

DESCRIPTION OF THE PREFERRED EMBODIMENT

Figure 1:
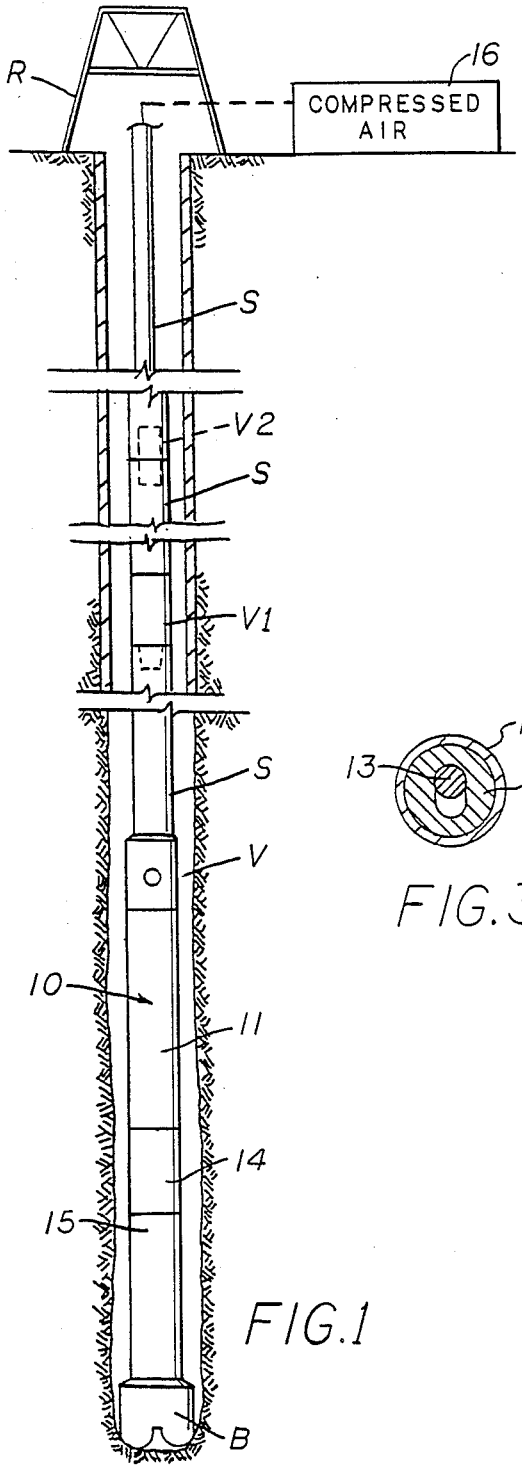
FIG. 1 is a schematic drawing showing a downhole drilling tool at the end of a drill string extending from a drilling rig on the surface with a control valve installed at the top end of the drill motor and modified versions of the valve are indicated in dotted line as installed in various sections of the drill string.
Figure 3:
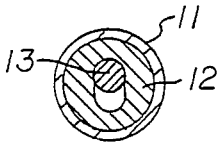
FIG. 3 is a cross section through the rotor/stator section of the drilling tool of FIG. 2.
Figure 2:
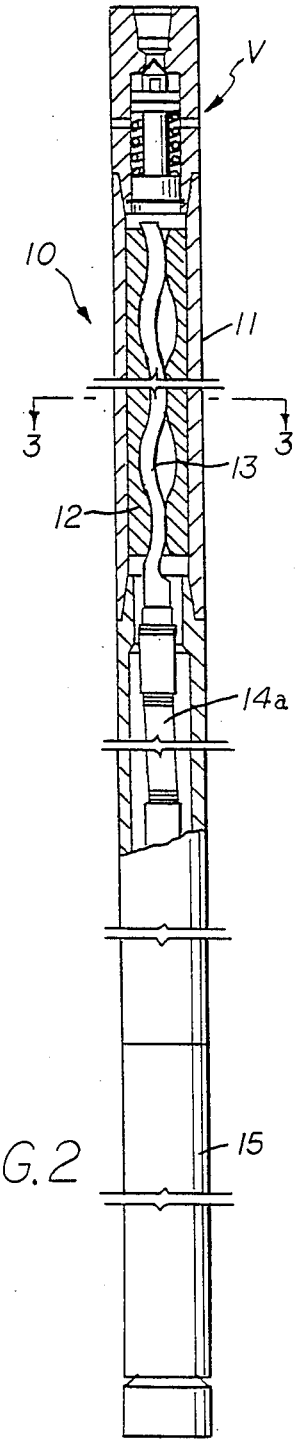
FIG. 2 is a schematic drawing in longitudinal cross section of a positive displacement downhole drilling tool having a control valve in accordance with the present invention installed at the top end.

Referring to the drawings by numerals of reference, and more particularly to FIGS. 1 and 2, there are shown schematic views, in vertical section, of downhole drilling apparatus.

In FIG. 1, there is shown a schematic view of a down-hole drilling tool 10 at the end of a drill string S extending from a drilling rig R on the surface with a control valve V alternatively installed at the top end of the drill motor and modified versions of the valve V1 and V2 are indicated in dotted line as installed in various sections of the drill string. The bore hole is shown straight, however, it should be understood, the the apparatus in accordance with the present invention may also be used in drilling deviated bore holes in earth formations.

A more detailed view of a typical pneumatic positive displacement drilling tool of the prior art is shown in FIG. 2. Conventional positive displacement motors such as the "Moineau" type comprise three sections: the rotor/stator section 11 which contains an elastomeric stator 12 and a steel rotor 13, the universal section 14 which contains the universal joints or flexible connection 14*a* that convert the orbiting motion of the rotor to the concentric rotary motion of the bit B, and the bearing pack section 15 which contains radial and thrust bearings to absorb high loads applied to the bit.

In such downhole drilling motors, a fluid, usually a relatively incompressible liquid is forced down the stationary drill pipe or drill string and on pasing through the fluid-operated motor causes the rotor 13 to rotate the drilling bit B. The drill string is normally held or suspended in such a manner that it does not rotate and therefore usually is held stationary. However, it is lowered in the well bore as drilling proceeds. Because of their simplicity and reliability, positive displacement motors of this type are also commonly used in pneumatic drilling utilizing air as the driving fluid.

The drill pipe string S is hollow and connected to the source 16 of compressed air. Compressed air from compressed air source 16 is supplied through hollow drill pipe to the pneumatic motor, or rotor/stator section 11 in the drilling tool which rotates the drill bit B. In one embodiment, a "tool joint" control valve V is installed in the top of the drilling tool 10 above or rearwardly of the motor section 11. The "tool joint" valve V utilizes a sub as part of the valve assembly and may be placed within the drill string at any desired point, as shown at V1.

A modified control valve or "cartridge" valve V2 may be installed inside the drill pipe at the threaded connection of two joints of drill pipe. Cartridge valve V2 eliminates the need for a sub with tool joints since the cartridge can be retro-fitted into a tool joint of the drill pipe. The cartridge valve V2 allows a quick change of the valve assembly by simply exchanging cartridges. The control valves will be shown and described in detail hereinafter.

The control valve is positioned in the drill string to control the introduction of air into the tool and prevent tool operation until the air line pressure has reached a predetermined level, remain open at a lower level of pressure, and close when the pressure is substantially turned off.

Figure 4A:
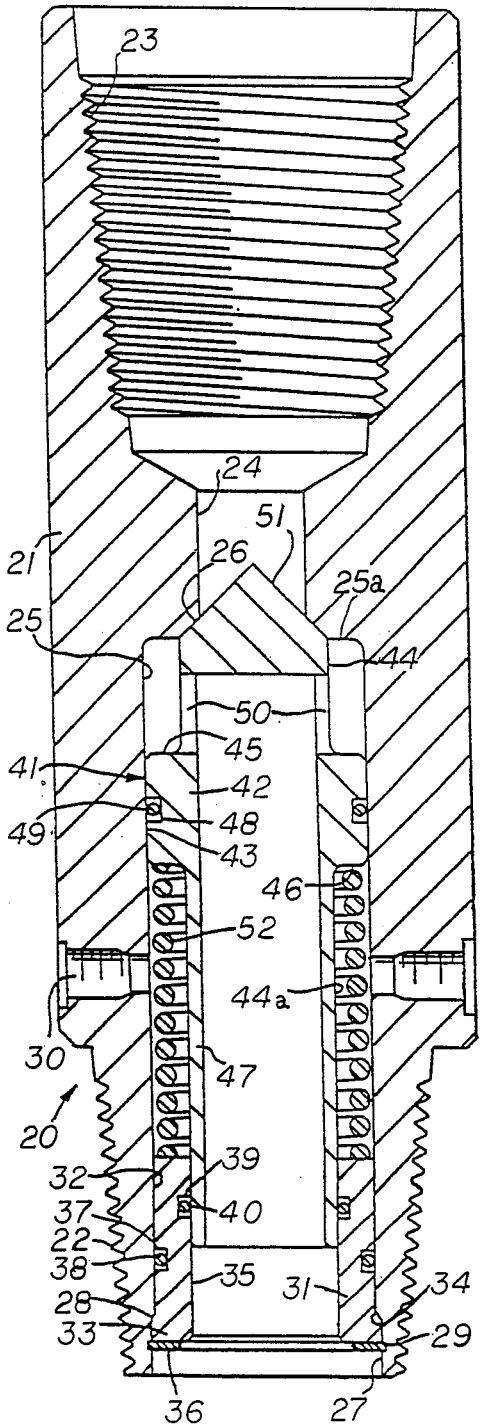
FIGS. 4A and 4B are longitudinal sections in the closed and open positions respectively of an embodiment of the control valve of the present invention which may be installed in the tool above the motor section or in the drill pipe string at any desired point.
Figure 4B:
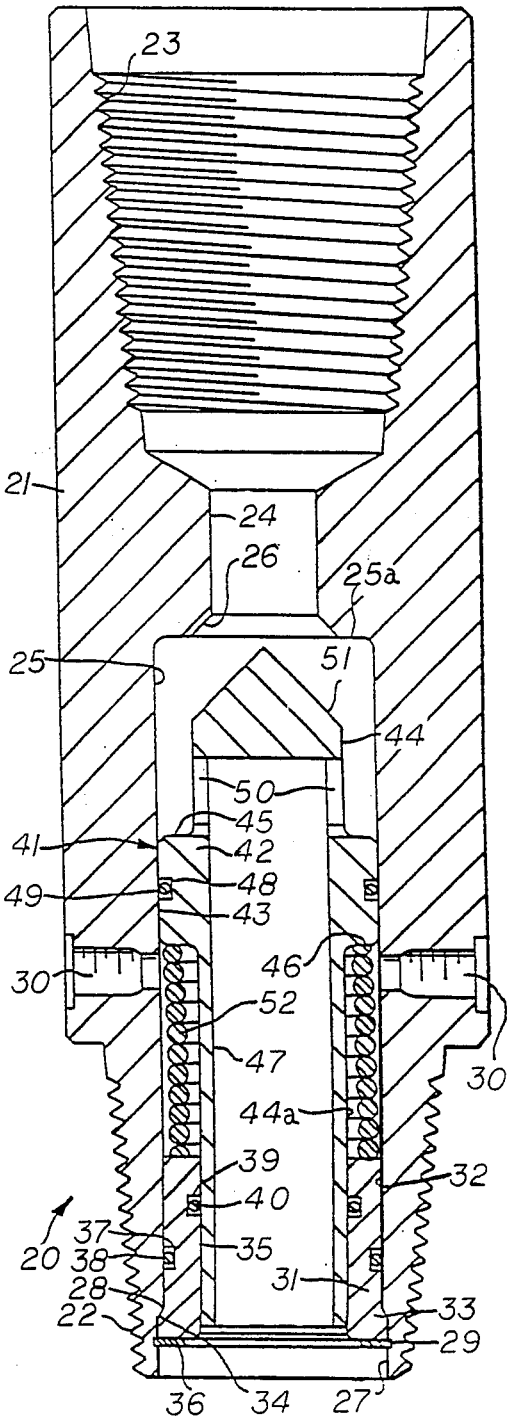

Referring now to FIGS. 4A and 4B, a "tool joint" control valve 20 is shown in the closed (FIG. 4A) and open (FIG. 4B) positions respectively. The "tool joint" valve assembly 20 comprises a cylindrical housing or valve body 21 having external male threads 22 on one end and female threads 23 on the opposed end and a smaller central longitudinal bore 24. An enlarged smooth bore 25 extends inwardly from the male threaded end of the body to define a flat shoulder 25a between the bores 24 and 25. A conical taper at the juncture of bore 24 with the flat shoulder forms a valve seat surface 26. The lower portion of the enlarged bore 25 is counterbored at 27 to define a shoulder 28. A snap ring groove 29 is provided in the side wall of counterbore 27 between the end of the body and the conical shoulder 28. Relief ports 30 extend through the side wall of the body 21 to communicate the enlarged bore 25 with atmosphere.

A cylindrical spring retainer and valve guide 31 has a first exterior diameter 32 and an enlarged diameter 33 at one end defining a shoulder 34 and central longitudinal smooth bore 35. Guide member 31 has a sliding fit inside the enlarged bore 25 and counterbore 27 of the body with shoulder 28 abutting shoulder 34, and is releasably secured therein by means of snap ring 36. An annular groove 37 and O-ring seal 38 are provided on the first exterior diameter 32 forming a seal between bore 25 and guide member 31. An annular groove 39 and O-ring seal 40 on inner bore 35 seal a guide extension on a piston valve member as described below.

A piston valve member 41 is positioned for sliding movement in the enlarged smooth bore 25. Piston valve member 41 comprises a hollow tubular body 42 enclosed at one end and having a larger exterior diameter 43 and reduced diameters 44 and 44*a* at opposite ends thereof defining a flat upper shoulder 45 and lower shoulder 46. A central longitudinal bore 47 extends inwardly from the open end and terminates at the closed end thereof. Reduced diameter 44*a* forms a valve guide extension having a sliding fit in bore 35 of guide member 31 for reciprocal guiding movement with O-ring 40 forming a seal therebetween.

The larger diameter 43 of the piston body 42 has a sliding fit in enlarged bore 25 of the valve body 21 for reciprocal movement therein. An annular groove 48 and O-ring seal 49 on the larger diameter 43 forms a seal between the smooth enlarged bore 25 and the exterior of the piston body. Apertures 50 through the side wall of the piston body 42 communicate the interior of the piston with the valve body bore 25. The end of the piston is a conical valve 51 fitting against conical valve seat surface 26 in the closed position as shown in FIG. 4A.

A coiled spring 52 surrounds the reduced diameter 44 of the piston body 42 and is compressed between the top end of guide member 31 and piston valve shoulder 46 to normally urge the conical valve 51 to closed position against the conical valve seat surface 26 of the valve body.

Because the valve body of this embodiment is essentially a sub, it may be placed within a drill string at any desired point. This embodiment is not restricted as to the size or design of the tool joint being used and is applicable to a wide range of drill pipe.

In FIGS. 9A and 9B, another embodiment of the control valve, referred to as the "cartridge" control valve is shown in the closed and open positions respectively. Some of the components of the "cartridge" valve are the same as those previously described and will be assigned the same numerals of reference. The proviously described "tool joint" embodiment utilizes the sub as part of the valve assembly where as the "cartridge" type is a removable valve assembly which is placed in a bore within the drill pipe at the threaded connection.

The "cartridge" valve assembly 53 comprises a housing having hollow cylindrical upper portion 54 with an end wall 55 and a cylindrical guide sleeve 56 fitted in the opposed end. A central bore 57 extends through the top wall 55 and forms a valve port. An enlarged smooth bore 58 extends inwardly a distance from the open end of the upper member 54 to define a shoulder 55*a* between bores 57 and 58. A conical transition at the junction of bore 57 and the shoulder forms a valve seat 59.

The exterior of the cylindrical guide sleeve 56 has a first diameter 60, a second intermediate diameter 61 larger than the first defining a flat shoulder 62 therebetween, and a third diameter 63 larger than the second defining a shoulder 64 therebetween. A central longitudinal smooth bore 65 extends through the sleeve 56. The first diameter 60 is slidably received in the enlarged bore 58 of the upper member 54. The second diameter 61 is substantially the same diameter as the outside diameter of the upper member 54 and shoulder 62 forms a stop against the open end of the upper member. Hollow removable dowel pins 66 in holes 67 in the side wall of the upper member 54 and aligned holes 68 in the sleeve side wall releasably secure the upper member 54 and sleeve 56 together.

The second diameter 61 of sleeve 56 and the exterior diameter of the upper member 54 are both slightly smaller than the bore 69 of a standard tool joint 70 to be slidably received therein. The third diameter 63 of sleeve 54 is larger than the bore 69 of the tool joint and the shoulder 64 serves as a stop against the open male end of the standard tool joint. The "cartridge" or assembled sleeve 56 and upper member 54 fit inside the tool joint bore 69 and the third diameter 63 of the sleeve extends a short distance beyond the male end of the tool joint 70. The sleeve diameter 63 is slightly less than the diameter of the thread run-out of the female threads 71 of the tool joint into which the tool joint containing the cartridge valve is threaded. In this manner, the "cartridge" control valve embodiment is secured in the drill pipe at the threaded connection.

A first seal comprising annular groove 72 and O-ring seal 73 on the exterior diameter of the upper member 54 and a second seal comprising annular groove 37 and O-ring seal 38 on the second diameter 61 of sleeve 56 form upper and lower fluid seals between the tool joint bore 69 and the exterior of the cartridge asembly. A third seal comprising annular groove 39 and O-ring seal 40 on the longitudinal bore 65 of the sleeve 56 seal against bore 69 of tool joint 70. Axially aligned relief ports 74 and 75 extend through the side wall of the tool joint 70 and the upper member 54 respectively to communicate the upper member bore 58 with atmosphere at a point intermediate the seals 38 and 49.

A piston valve member 41 is positioned for sliding movement in the enlarged smooth bore 59. Piston valve member 41 comprises a hollow tubular body 42 closed at one end and having a larger exterior diameter 43 and reduced diameters 44 and 44*a* at opposite ends thereof defining a flat upper shoulder 45 and lower shoulder 46. A central longitudinal bore 47 extends inwardly from the open end and terminates at the closed end 48. Reduced diameter 44*a* forms a valve guide extension having a sliding fit in bore 65 of sleeve 56 for reciprocal guiding movement with O-ring 40 forming a seal therebetween.

The larger diameter 43 of the piston body 42 has a sliding fit in enlarged bore 58 of the valve body 54 for reciprocal movement therein. An annular groove 48 and O-ring seal 49 on the larger diameter 43 forms a seal between the smooth enlarged bore 58 and the exterior of the piston body. Apertures 50 through the side wall of the piston body 42 communicate the interior of the piston with the valve body bore 58. The end of the piston is a conical valve 51 fitting against conical valve seat surface 26 in the closed position as shown in FIG. 9A.

A coiled spring 52 surrounds the reduced diameter 44 of the piston body 42 and is compressed between the top end of guide sleeve 56 and piston valve shoulder 46 to normally urge the conical valve 51 to closed position against the conical valve seat surface 59 of valve body 54.

The "cartridge" control valve embodiment eliminates the need for a sub with tool joints since the cartridge can be retro-fitted into a tool joint of the drill pipe. The cartridge model allows a quick change of the valve assembly by simply exchanging cartridges.

OPERATION

As the driling tool progresses away from the rig, more drill pipe is added between the drilling tool and the rig. As each joint of drill pipe is added to the drill string, air flow to the tool must be interrupted and the drill string emptied of air pressure. Once the connection of another joint of drill pipe is completed, the air flow to the downhole tool can be initiated. Thus, the drill pipe is, in effect, forming an ever increasing expansion chamber as the tool advances. Expansion of the compressed air entering the empty drill string drastically reduces the initial air pressure and energy potential available to start the tool motor in operation. This energy potential builds up slowly because of a limited or fixed capacity for generating compressed air entering the lengthened drill pipe. Since most air compressors have small air tanks, the time required to fill the pipe increases as the length and/or diameter of pipe increases. If pressure buildup inside the motor is slow, the pressure leaks across the rotor/stator and the tool will be difficult to start.

The pneumatic drilling tool requires a certain impulse of energy to initiate operation because of inertia, internal friction and leakage, and excessive drag on the drill bit. This may be further aggravated by ineffective lubrication or frost conditions from air expansion within the tool. In cold atmospheric conditions, a pneumatic motor may freeze moisture in the tight seal areas.

The control valve of the present invention is installed upstream of the tool motor, and generally adjacent thereto, in the drill string and allows the pressure to build-up before reaching the rotor/stator section. At a predetermined pressure, the valve opens and allows air at operating pressure to immediately blast the rotor/stator section. This prevents the pressure from equalizing across the rotor/stator and allows the tool to start.

A high-pressure blast provided by the control valve will help break-up and remove the frozen moisture and allow the tool to operate. This technique also applies to borehole water that may have flowed into the tool. The valve provides an air blast which forces a majority of the water out and allows the tool to start.

Figure 5A:
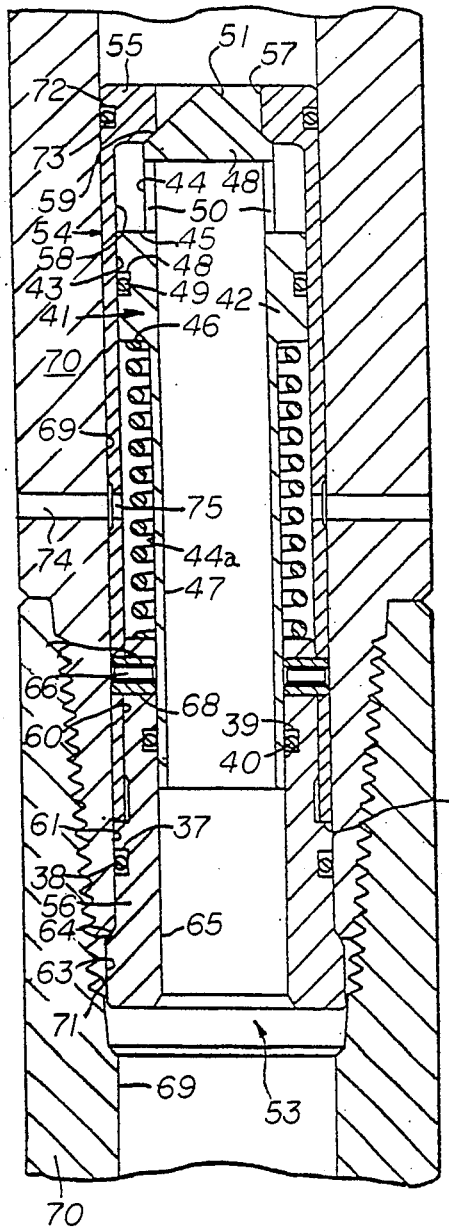
FIGS. 5A and 5B are longitudinal sections in the closed and open positions respectively of a modification of the embodiment of the control valve of FIGS. 4A and 4B which may be installed inside a drill pipe connection.
Figure 5B:
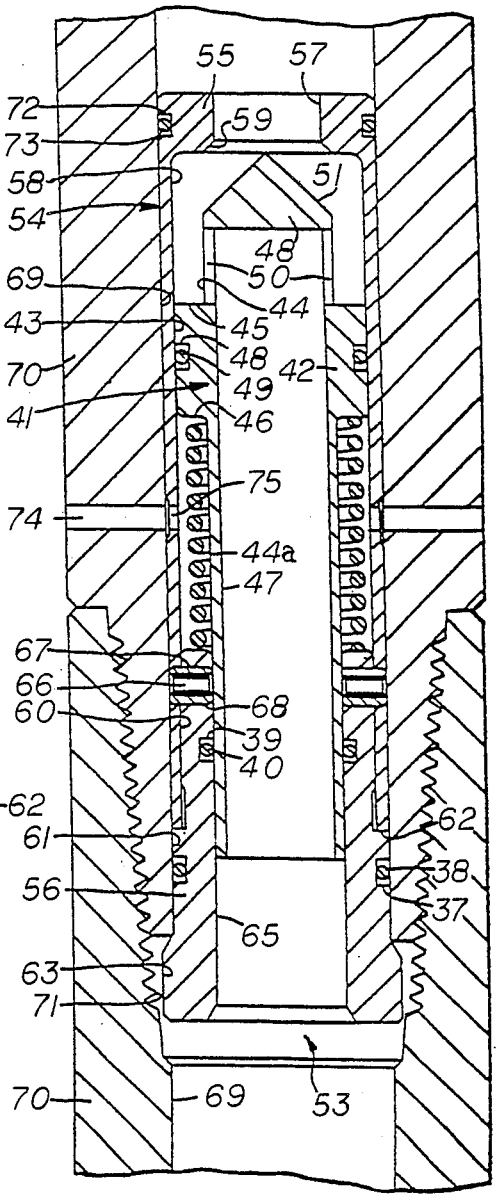

The forms of the downhole valve previously described in detail utilize the same basic components and operate in similar fashion. The embodiments of FIGS. 4A, 4B and 5A, 5B have basically one moving part, the piston valve. The following description is with reference to FIGS. 4A and 4B but is applicable to the valve of FIGS. 5A and 5B, as well.

The control valve 20 is installed in the drill string or top of the tool. The valve 20 is initially closed, at low or no pressure, and is subjected to line pressure as the air pressure is turned on. When the line pressure reaches a predetermined level the valve is opened by moving the valve piston 41 against the closing force of the coil spring 52 normally closing the valve.

When the valve 51 is opened, the air flows through the open valve port 24 and the apertures 50 in the piston valve member 41 and on to the drilling tool. In the valve open position, the air pressure acting on the enlarged diameter portion, i.e. shoulder 45, of the valve piston 41 provides sufficient pressure differential relative to bore hole pressure to which it is exposed through the vent holes 30 in the valve body will hold the valve in the open position. The dual seal design, i.e. upper and lower seals 49 and 38, requires a relatively large opening pressure but, due to a seal area increase, requires a lower pressure to remain open. This compensates for unintentional pressure reductions in the supply line and allows the tool to keep running if the pressure should drop below the opening pressure yet remain above the closing pressure which is a function of spring strength and seal area. Typically the closing pressure is set to be approximately half the opening pressure.

The valve is adjustable with respect to opening pressure. The opening pressure is altered by changing the coil spring 52. A higher opening pressure would require a stiffer spring, likewise a lower opening pressure would utilize a softer spring. The valve is also designed to minimize pressure drop and reductions in flow rate. This is accomplished by taking the pressure drop that opens the valve across the valve seat, while taking the pressure drop that holds the valve open from the bore of the valve to the hole annulus, instead of across the seal seat. This not only maintains working pressure for the tool but also maintains the flow rate and allows the valve to remain open with a minimum of pressure drop.

The valve is self-cleaning in the vent hole due to the sealed cavity behind the vent opening. As the valve opens, the pressure build-up within the cavity escapes out the vent and forces out any solid matter which may have been trapped.

Tests have been conducted on the inline control valve according to FIGS. 8–10 to determine operational characteristics such as cracking pressure, closing pressure, and pressure drop across the valve at maximum flow. The in-line valve assembly was placed directly behind the air motor. The valve will function well with low pressure rotary drills and also with high pressure drills operated by positive displacement Moineau motors.

While this invention has been described fully and completely with special emphasis upon several preferred embodiments of the invention it should be understood that within the scope of the appended claims the invention may be practiced otherwise than as specifically described above.

We claim:

1. An earth drilling apparatus comprising a rotary drill bit and a rotary, pneumatically-operated motor connected to said drill bit for rotating the same, said motor comprising a housing and a rotor/stator section comprising a stator supported therein, and a rotor rotatable in said stator and having an end portion supporting said drill bit for rotary movement thereby, said housing having an inlet for introduction of pneumatic fluid to rotate said rotor and said drill bit and conduit means having one end operatively connected to said housing inlet and another end adapted to be connected to a source of pneumatic fluid, pneumatic pressure operated valve means positioned in said conduit means substantially adjacent to said housing between said housing and said source of pneumatic fluid controlling the flow of pneumatic fluid to said rotor/stator motor section, said pneumatic pressure operated valve means comprising valve means and means operable in response to the pressure of pneumatic fluid in said conduit means to open said valve means to permit flow of pneumatic fluid through said conduit means to said motor only on attaining a predetermined operating pressure in said conduit means to transmit an initial pulse of pneumatic fluid to initiate rotation of said rotor, and said valve means being maintained open at a predetermined lower conduit means pressure than that required to open the same.

2. An earth drilling apparatus according to claim 1 in which said motor is a positive displacement motor.

3. An earth drilling apparatus according to claim 1 in which said motor is a Moineau motor in which said stator has a helical cavity, and said rotor is a helical rotor rotatable in in said cavity to provide a helically moving cavity as the rotor is rotated by application of pneumatic pressure.

4. An earth drilling apparatus according to claim 1 in which said valve means and pressure responsive means comprise a pressure-operated valve, spring-loaded toward closed position and opening at a first predetermined pneumatic pressure in said conduit means permitting flow through said conduit means to said tool rotor/stator motor and closing at a second, substantially lower, predetermined pneumatic pressure in said conduit means.

5. An earth drilling apparatus according to claim 4 in which said pneumatic pressure-operated valve means comprises a tubular housing having an inlet at one end and an outlet at the other end, a longitudinal passageway through said housing including a valve port and seat at the inlet end, an enlarged portion in said passageway on the outlet side of said valve port, a piston valve member positioned for reciprocal sliding movement in said enlarged passageway portion, said piston valve member having a diameter larger than said valve port and an end portion movable to closed or to open position relative to said valve seat, spring means engaging said piston valve member and biasing it toward closed position, said housing having vent openings through its wall from said enlarged passageway portion at a point intermediate said valve port and said outlet, and means sealing said piston valve member relative to said enlarged passageway portion on opposite sides of said vent openings, said piston valve member being opened by the pressure differential between the inlet side of said valve port and said housing outlet and being maintained open by the differential pressure between the inlet side of said piston valve member, when open, and the pressure outside said vent holes.

6. An earth drilling apparatus according to claim 5 in which said housing is substantially cylindrical with male-threads at one end and female threads at the other end for connection in a drill string.

7. An earth drilling apparatus according to claim 5 in which said housing is a substantially cylindrical cartridge with a peripheral enlargement adjacent to the outlet end, and shaped to fit inside a drill pipe or collar.

8. An earth drilling apparatus according to claim 5 in which said piston valve member comprises a piston portion of enlarged diameter having a sliding fit in said enlarged passageway portion, a smaller diameter portion on one side with an end portion providing a valve engageable with said valve seat to open and close the same, a hollow tubular guide extension on the other side, and openings through said smaller diameter portion into the interior of said hollow tubular guide extension, said openings and tubular guide extension providing a passage through said valve in the opened position, the outlet end of said housing having guide surface means receiving said tubular guide extension in a sliding relation to guide longitudinal movement of said valve member, said spring means comprising a coil spring surrounding said tubular guide extension and compressed between said piston portion and said guide surface means, said housing vent openings being located at a point intermediate said piston portion and guide surface means, and said sealing means comprising a peripheral seal between said piston portion and said enlarged passageway and a peripheral seal between said tubular guide extension and said guide surface.

9. An earth drilling apparatus according to claim 8 in which said guide surface means comprises a tubular sleeve member positioned in the outlet end portion of said enlarged passageway portion, and including means retaining said tubular sleeve in position, and a peripheral seal between said tubular sleeve and the wall of said enlarged passageway portion.

10. An earth drilling apparatus according to claim 5 in which said housing is formed in two parts comprising an inlet end part and an outlet end part means retaining said housing parts together, said piston valve member comprises piston portion of enlarged diameter having a sliding fit in said enlarged passageway portion, a smaller diameter portion on one side with an end portion providing a valve engageable with said valve seat to open and close the same, a hollow tubular guide extension on the other side, and openings through said smaller diameter portion into the interior of said hollow tubular guide extension, said openings and tubular guide extension providing a passage through said valve in the open position, a tubular sleeve portion on said housing outlet end part extending inside said housing inlet end part providing a guide surface receiving said tubular guide extension in a sliding relation to guide longitudinal movement of said valve member, said spring means comprising a coil spring surrounding said tubular guide extension and compressed between said piston portion and said housing sleeve portion, said housing sleeve vent openings being located at a point intermediate said piston portion and said housing sleeve portion, and said sealing means comprising a peripheral seal between said piston portion and said enlarged passageway and a peripheral seal between said tubular guide extension and said guide surface.

11. An earth drilling apparatus according to claim 10 in which said housing portions are secured together by dowel pins.

12. An earth drilling apparatus according to claim 11 in which said housing is a substantially cylindrical cartridge with a peripheral enlargement adjacent to the outlet end, and shaped to fit inside a drill pipe or collar.

13. A method of drilling well bores in the earth which comprises providing a pneumatic motor operated rotary drilling tool having an inlet for introduction of pneumatic fluid to operate said motor, providing a source of pneumatic fluid and conduit means from said tool inlet to said source of pneumatic fluid, said drilling tool having a motor comprising a housing in which said inlet is located and a rotor/stator section comprising a stator supported therein, and a rotor rotatable in said stator and having an end portion supporting said drill bit for rotary movement thereby, applying said pneumatic fluid to said tool inlet to operate said rotor/stator motor, and automatically restraining said application of pneumatic fluid to said tool inlet until the pneumatic pressure in said conduit means adjacent to said tool has reached a predetermined level so that the initial application of pneumatic fluid from said conduit to said rotor/stator motor section is as a pulse of pneumatic fluid to initiate rotor/stator motor movement.

14. A method according to claim 13 in which said step of restraining application of pneumatic fluid is carried out by providing valve means positioned in said conduit means substantially adjacent to said tool between said tool inlet and said source of pneumatic fluid controlling the flow of pneumatic fluid to said tool, said valve means including pneumatic pressure operated valve means operable in response to the pressure of pneumatic fluid in said conduit means to be opened to permit flow of pneumatic fluid to said tool at a predetermined operating pressure in said conduit to transmit an initial pulse of pneumatic fluid from said conduit means to initiate operation of said rotor/stator motor, and applying sufficient pneumatic fluid pressure to said valve means to open the same, said pneumatic pressure operated valve means being maintained open at a predetermined lower pressure in said conduit means than that required to open the same.

15. A method according to claim 14 in which said pneumatic pressure operated valve means comprises a pressure-operated valve, spring-loaded toward closed position and opening at a first predetermined pneumatic pressure in said conduit means permitting flow through said conduit means to said tool inlet and closing at a second, substantially lower, predetermined pneumatic pressure in said conduit means.

16. A method according to claim 15 in which said pneumatic pressure-operated valve means comprises a tubular housing having an inlet at one end and an outlet at the other end, a longitudinal passageway through said housing including a valve port and seat at the inlet end, an enlarged portion in said passageway on the outlet side of said valve port, a piston valve member positioned for reciprocal sliding movement in said enlarged passageway portion, said piston valve member having a diameter larger than said valve port and an end portion movable to closed or to open position relative to said valve seat, spring means engaging said piston valve member and biasing it toward closed position, said housing having vent openings through its wall from said enlarged passageway portion at a point intermediate said valve port and said outlet, means sealing said piston valve member relative to said enlarged passageway portion on opposite sides of said vent openings, and applying pressure to said inlet whereby said piston valve member is opened by the pressure differential between the inlet side of said valve port and said housing outlet and maintained open by the differential pressure between the inlet side of said piston valve member, when open, and the pressure outside said vent holes.

* * * * *